US009247833B2

(12) United States Patent
Pena

(10) Patent No.: US 9,247,833 B2
(45) Date of Patent: Feb. 2, 2016

(54) SECURITY HOOK DEVICE AND METHOD

(71) Applicant: TRACFONE WIRELESS, INC., Miami, FL (US)

(72) Inventor: Elvis Pena, Miami, FL (US)

(73) Assignee: TRACFONE WIRELESS, INC., Miami, FL (US)

( * ) Notice: Subject to any disclaimer, the term of this patent is extended or adjusted under 35 U.S.C. 154(b) by 178 days.

(21) Appl. No.: 13/932,257

(22) Filed: Jul. 1, 2013

(65) Prior Publication Data

US 2015/0001167 A1 Jan. 1, 2015

(51) Int. Cl.
*A47F 5/08* (2006.01)

(52) U.S. Cl.
CPC ..... *A47F 5/0861* (2013.01)

(58) Field of Classification Search
CPC ..... A47F 1/04; A47F 1/12; A47F 1/125; A47F 1/126; A47F 1/128; A47F 3/14; A47F 7/0007; A47F 7/0014; B65D 73/0064
USPC ..... 211/7, 9, 51, 54.1, 57.1, 59.1, 59.2, 211/59.3; 312/61, 71; 108/60, 61
See application file for complete search history.

(56) References Cited

U.S. PATENT DOCUMENTS

| | | | | | |
|---|---|---|---|---|---|
| 4,223,542 | A * | 9/1980 | Basseches | 70/58 |
| 4,289,242 | A * | 9/1981 | Kenyon | 211/4 |
| 4,742,923 | A * | 5/1988 | Calvert | 211/57.1 |
| 5,009,334 | A * | 4/1991 | Bodkins | 211/54.1 |
| 5,423,436 | A * | 6/1995 | Morrow | 211/59.1 |
| 5,855,282 | A * | 1/1999 | Hardy | 211/59.1 |
| 6,102,192 | A * | 8/2000 | Tomuro et al. | 198/747 |
| D521,363 | S * | 5/2006 | Copen et al. | D8/363 |
| 7,197,902 | B1 * | 4/2007 | Barkdoll | 70/57.1 |
| 7,219,806 | B1 * | 5/2007 | Morrow | 211/59.1 |
| 8,281,624 | B2 * | 10/2012 | Rizzi | 70/14 |
| 2004/0026344 | A1 * | 2/2004 | Sedon et al. | 211/7 |
| 2005/0029205 | A1 * | 2/2005 | Mansfield et al. | 211/7 |
| 2006/0157431 | A1 * | 7/2006 | Nagelski et al. | 211/54.1 |
| 2007/0062890 | A1 * | 3/2007 | Nagelski et al. | 211/57.1 |
| 2007/0289344 | A1 * | 12/2007 | Fawcett et al. | 70/58 |
| 2008/0169250 | A1 * | 7/2008 | Nagelski | 211/7 |
| 2008/0209960 | A1 * | 9/2008 | Nagelski | 70/57.1 |
| 2009/0057244 | A1 * | 3/2009 | Conti et al. | 211/7 |
| 2009/0095695 | A1 * | 4/2009 | Moock et al. | 211/57.1 |
| 2009/0173853 | A1 * | 7/2009 | Fawcett et al. | 248/220.31 |
| 2010/0206825 | A1 * | 8/2010 | Johnston et al. | 211/59.2 |
| 2010/0223965 | A1 * | 9/2010 | Richardson et al. | 70/58 |
| 2010/0300992 | A1 * | 12/2010 | Surma et al. | 211/7 |
| 2011/0036789 | A1 * | 2/2011 | Richardson et al. | 211/1.57 |
| 2011/0215061 | A1 * | 9/2011 | Niederhuefner et al. | 211/59.3 |
| 2011/0266235 | A1 * | 11/2011 | Vulpitta | 211/59.1 |
| 2013/0112634 | A1 * | 5/2013 | Nagel | 211/59.3 |
| 2013/0193095 | A1 * | 8/2013 | Nagel | 211/59.3 |

* cited by examiner

*Primary Examiner* — Joshua Rodden
(74) *Attorney, Agent, or Firm* — Baker & Hostetler LLP

(57) ABSTRACT

A security system includes a display tray, header panel, hook, hook base cover, and hook end cover. The display tray is to display an item. The display tray includes a slot. The header panel has a tab portion and a head portion. The tab portion is configured to mate with the slot. The head portion has one or more prong receiving holes. The hook has one or more prongs. The hook is to receive the item. The one or more prongs are configured to mate with the one or more prong receiving holes. The hook base cover is to secure the hook to the head portion. The hook end cover is configured to lock to an end of the hook. The item received on the hook is secured by locking the hook end cover to the hook.

16 Claims, 6 Drawing Sheets

SECURITY HOOK DEVICE AND METHOD

FIELD OF THE INVENTION

The invention generally relates to a security hook device. More particularly, the invention pertains to a security hook device and method of securing goods for display.

BACKGROUND OF THE INVENTION

Goods for sale are often set out for display in stores so that customers may view and select the goods for purchase. In order to increase sales, the goods may be displayed within easy reach of the customers. Unfortunately, increased visibility and/or availability may also increase the opportunities for theft. Depending upon a number of factors, the goods may include a variety of security measures to reduce theft. For example, relatively small and valuable items may be kept behind a counter and/or in a locked security cabinet. However, these and other deterrents may reduce visibility of the goods and result in lower sales.

Electronic article surveillance (EAS) tags may be used in conjunction with detectors for some goods to deter theft without reducing visibility. A variety of EAS systems are available such as, for example: magneto-harmonic; acousto-magnetic; radio frequency; microwave; and the like. However, these tags increase the cost of each article and may not be appropriate for some venues.

Accordingly, it is desirable to provide a security device and method of securing goods for sale that is capable of overcoming the disadvantages described herein at least to some extent.

SUMMARY OF THE INVENTION

The foregoing needs are met, at least to a great extent, by the invention, wherein in one respect a device and method is provided that in some aspects secures goods for sale.

An aspect of the invention pertains to a security system. The security system includes a display tray, header panel, hook, hook base cover, and hook end cover. The display tray is to display an item. The display tray includes a slot. The header panel has a tab portion and a head portion. The tab portion is configured to mate with the slot. The head portion has one or more prong receiving holes. The hook has one or more prongs. The hook is to receive the item. The one or more prongs are configured to mate with the one or more prong receiving holes. The hook base cover is to secure the hook to the head portion. The hook end cover is configured to lock to an end of the hook. The item received on the hook is secured by locking the hook end cover to the hook.

Another aspect of the invention relates to a security hook assembly. The security hook assembly includes a header panel, hook, hook base cover, and hook end cover. The header panel has a tab portion and a head portion. The tab portion is configured to mate with a slot in a display tray. The head portion has one or more prong receiving holes. The hook has one or more prongs. The hook is to receive the item. The one or more prongs are configured to mate with the one or more prong receiving holes. The hook base cover is to secure the hook to the head portion. The hook end cover is configured to lock to an end of the hook. The item received on the hook is secured by locking the hook end cover to the hook.

There has thus been outlined, rather broadly, certain aspects of the invention in order that the detailed description thereof herein may be better understood, and in order that the present contribution to the art may be better appreciated. There are, of course, additional aspects of the invention that will be described below and which will form the subject matter of the claims appended hereto.

In this respect, before explaining at least one aspect of the invention in detail, it is to be understood that the invention is not limited in its application to the details of construction and to the arrangements of the components set forth in the following description or illustrated in the drawings. The invention is capable of aspects in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the invention. It is important, therefore, that the claims be regarded as including such equivalent constructions insofar as they do not depart from the spirit and scope of the invention.

DETAILED DESCRIPTION OF THE INVENTION

Figure 1:
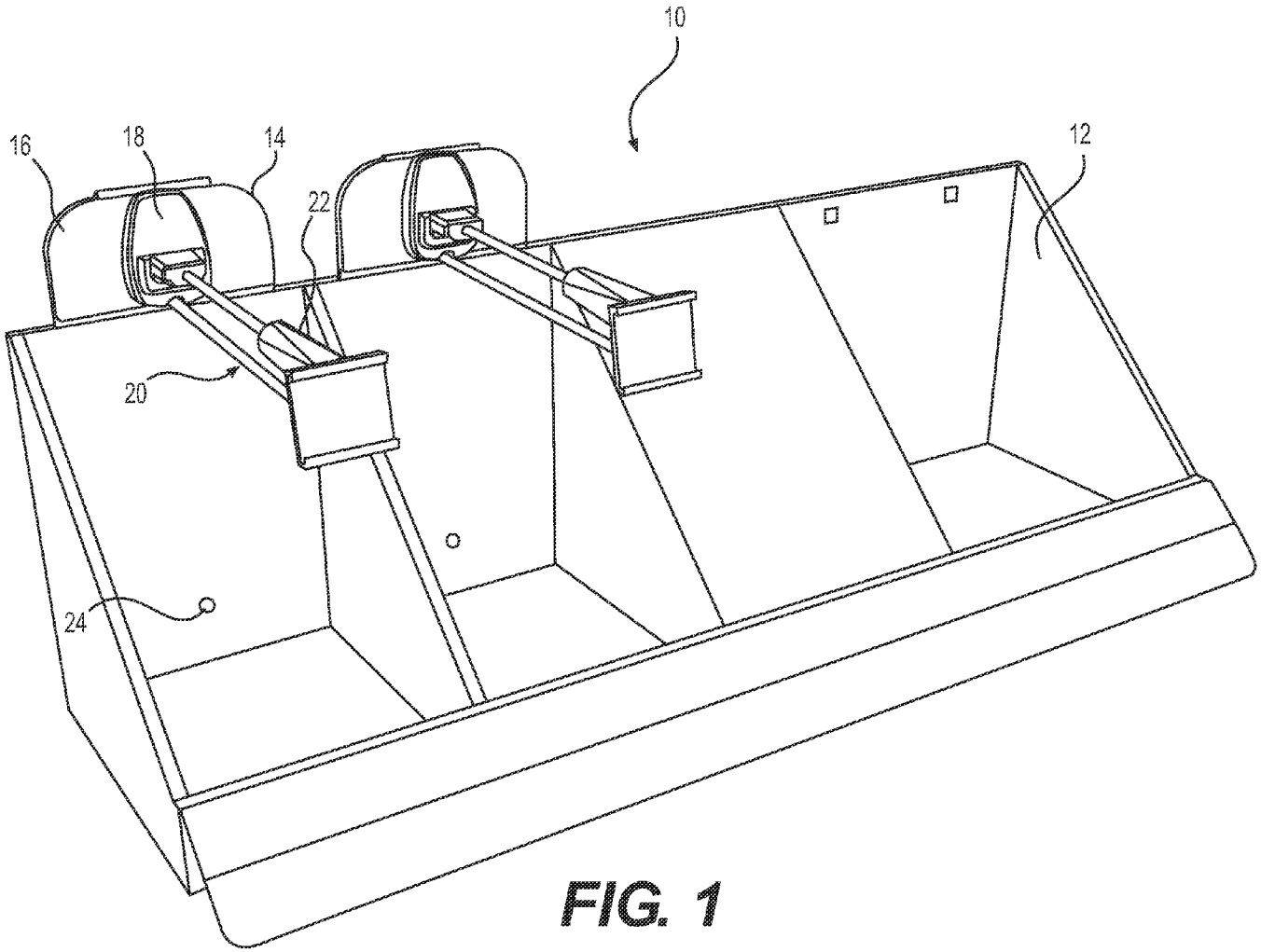
FIG. 1 is a perspective view of a security tray system according to an aspect of the invention.

An aspect of the invention will now be described with reference to the drawing figures, in which like reference numerals refer to like parts throughout. As shown in FIG. 1, a security tray system 10 includes a tray 12 and a security hook assembly 14. The security hook assembly 14 includes a header panel 16, hook base cover 18, hook 20, hook end cover 22, and fastener 24. The security tray system 10 is configured to securely display a product 26 for view or sale.

The tray 12 is configured to retain one or more of the product 26. In addition, the tray 12 may include advertising and/or related product information. The tray 12 may be constructed from any suitable material or materials. Examples of suitable materials include paperboard, fiberboard, polymers, metals, other natural and/or synthetic sheet stock, and the like. In a particular example, the tray 12 includes corrugated polymer fiberboard sheet stock that is cut, scored, and folded into the conformation shown. As shown, the tray 12 may be configured to rest on a counter, shelf and/or other such horizontal surface. In this or other examples, the tray 12 may rest on or may be fastened to a base (not shown) to provide a free-standing display for the products 26 (shown in FIG. 6). In one aspect, the tray 12 may be fastened to a base such as a countertop with structure similar to the fastener 24 and header panel 16 described herein. More particularly, the product 26 may be secured to the hook 20 via a hang tag 28 (shown in FIG. 6).

The security hook assembly 14 is configured to secure the product 26 to the tray 12. As shown herein, the security hook assembly 14 is secured to the tray 12 via the fastener 24. In turn, the product 26 is secured to the hook 20. In this manner, a relatively small, portable article for sale that might otherwise be hidden in a purse or under clothing may be made unwieldy and unlikely to be removed without notice. The product 26 is affixed to the hook 20 in a variety of suitable ways. For example, as described herein, the hook end cover 22 may be removed to uncover the end of the hook 20 and one or more product 26 may be threaded onto the hook 20. The one or more product 26 may then be secured by replacing the hook end cover 22 and re-locking the hook end cover 22 to the hook 20. To remove the product 26, such as in response to a sale of the product 26, the hook end cover 22 may be unlocked and removed from the hook 20 and the product 26 or hang tag 28 may be unthreaded from the hook 20. Any remaining ones of the product 26 may be re-secured by replacing and locking the hook end cover 22 to the hook 20.

In another example, the security hook assembly 14 may be preassembled with the product 26 at a manufacturing facility. In response to a sale, a sales agent may free the product 26, for example by cutting the hang tag 28 from the hook 20. Once the last product 26 has been removed from the hook 20, the security hook assembly 14 may be removed by removing the fastener 24 and withdrawing the header panel 16 as described herein.

In yet another example, the hook end cover 22 may include a one-way fastener that allows the hook end cover 22 to be placed on the hook 20 but not withdrawn. In this example, the one or more products 26 may be placed on the hook 20 via the hang tag 28 and then secured by affixing the hook end cover 22 to the end of the hook 20. In response to a sale, a sales agent may free the product 26, for example by cutting the hang tag 28 from the hook 20. These and other examples of securing the product 26 to the security tray system 10 are within the purview of the various aspects of the invention.

Figure 2:
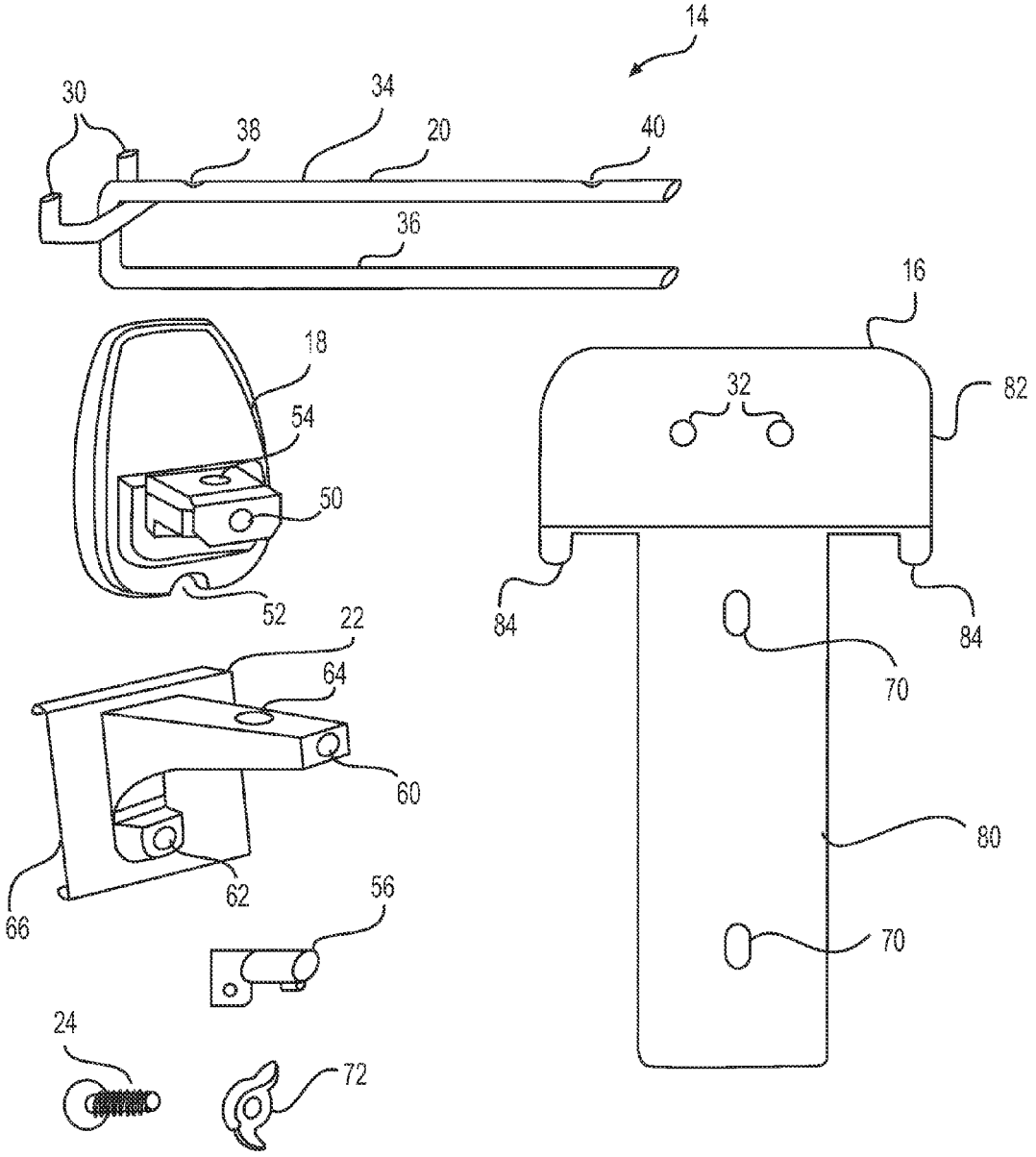
FIG. 2 is a perspective view of elements of a security hook assembly according to FIG. 1.

FIG. 2 is a perspective view of elements of a security hook assembly 14 according to FIG. 1. As shown in FIG. 2, the hook 20 includes a pair of prongs 30 to mate with a corresponding pair of holes 32 disposed in the header panel 16. The hook 20 optionally includes an upper rod 34 and lower rod 36. However, in other examples, the upper and lower rods 34 and 36 may be subsumed in a single rod, a flat bar, a cable, or the like. The upper rod 34 optionally includes one or more detents to facilitate locking the elements of the security hook assembly 14 together. For example, the rod 34 may include a detent 38 to facilitate locking the hook base cover 18 and a detent 40 to facilitate locking the hook end cover 22 to the end of the rod 34. The lower rod 36 is configured to provide an attachment place for the product 26.

The hook base cover 18 includes a through bore 50, a notch 52, and an optional lock 54. The through bore 50 is sized to slide along the upper rod 34. The notch 52 is configured to capture the lower rod 36 and prevent the hook base cover 18 from being rotated about the upper rod 34. As shown herein, by securing the hook base cover 18 to the hook 20, the prongs 30 are prevented from being withdrawn from the holes 32. If included, the lock 54 is configured to be selectively locked and unlocked by a key 56. The lock 54 may include a key receiving aperture shaped with a profile that is substantially similar to the profile of the key 56. The key 56 may include a portion on the end thereof for grasping by the user. The key 56 may further include on the other end thereof, the above-noted profile together with a portion to engage the lock 54. The engaging portion of the key 56 manipulating components internal to the lock 54 to employ locking functionality or unlocking functionality to the lock 54. Additional components or other components as is known in the art may be a part of the lock 54 and key 56 as well. Additionally, other blocks described with respect to the invention may be implemented similarly.

The hook end cover 22 includes a bore 60, a bore 62, and an optional lock 64. The bore 60 is sized to accept the end of the rod 34. If included, the lock 64 may be used with the key 56 to secure the hook end cover 22 to the rod 34 by urging a pawl (not shown) to engage the detent 40. The bore 62 is configured to accept the end of the rod 36. Optionally, the hook end cover 22 includes a product label holder 66. If included, the product label holder 66 is configured to display a product label or other information related to the product 26, for example.

The fastener 24 is configured to secure the header panel 16 to the tray 12. In a particular example, the fastener is a screw configured to be inserted through one or more fastener holes 70 disposed in the header panel 16 and corresponding holes disposed in the tray 12 (shown in FIGS. 3-6). In various examples, the fastener 24 may be secured using a nut such as a wing nut 72, threading in the fastener holes 70, or the like. In other examples, the fastener 24 may include a pin, rivet, or other such fastener. In still other examples, the fastener 24 may be omitted and the header panel 16 may be affixed to the tray 12 via an adhesive, stapling, or the like.

The header panel 16 may include any suitable material. Suitable materials include metals, polymers, and the like. Particular examples of suitable materials include steel, polycarbonate, and other relatively high strength materials. The header panel includes a tab 80 and head 82. The tab 80 is configured to slide into a slot in the tray 12 (Shown in FIGS. 3-5). The head 82 is configured to support and secure the hook 20. The head 82 optionally includes a pair of outer tabs 84. If included, the outer tabs 84 are configured to assist in aligning and maintaining the alignment of the header panel 16 with the tray 12.

Figure 3:
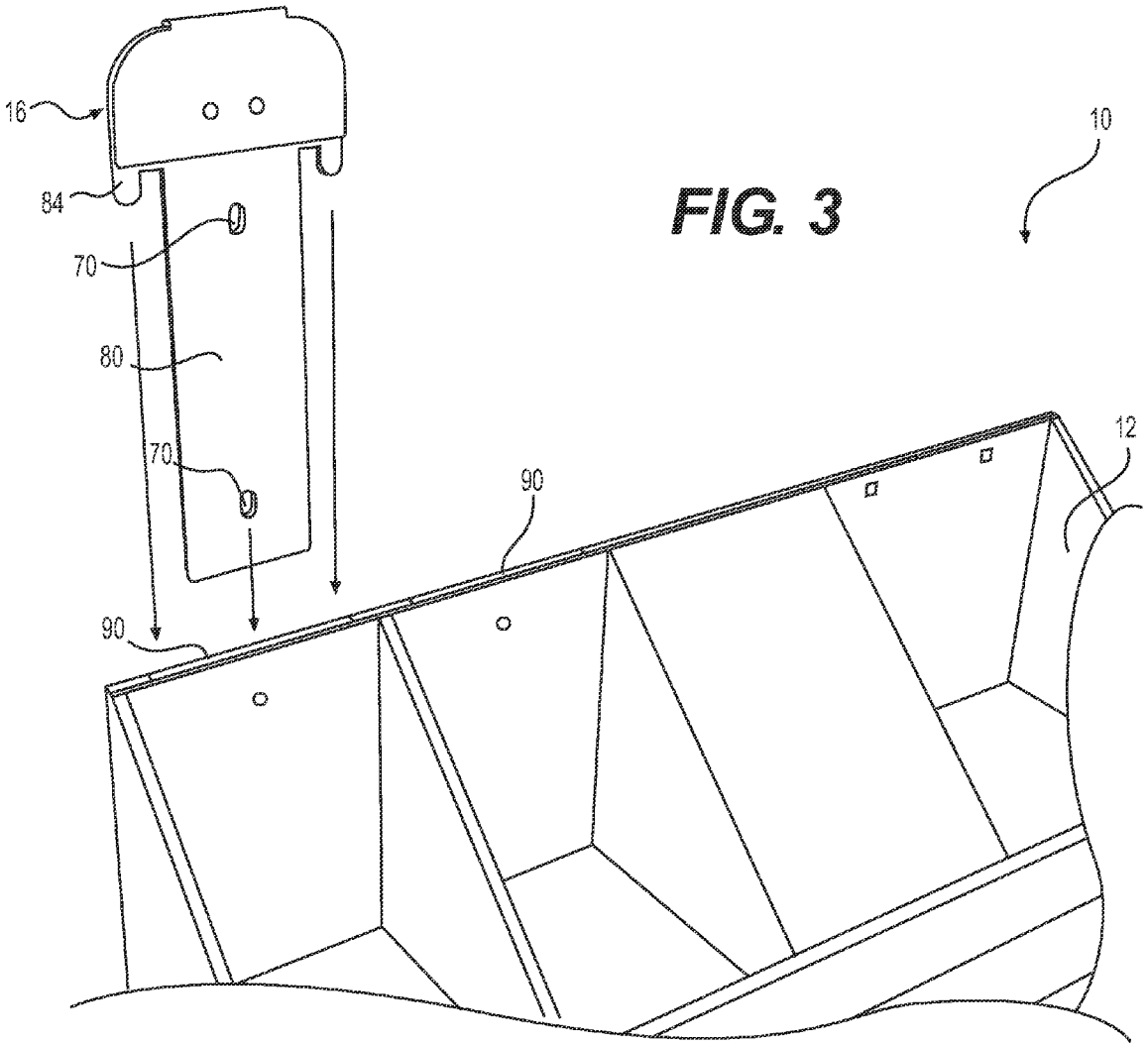
FIG. 3 is a perspective view of an initial step in the assembly of the security tray system according to FIG. 1.

FIG. 3 is a perspective view of an initial step in the assembly of the security tray system 10 according to FIG. 1. As shown in FIG. 3, the tab 80 is inserted into a slot 90. In general, the tab 80 is configured to mate with the slot 90. However, if the outer tabs 84 are included, the slot 90 may be configured to accommodate the outer tabs 84 as well. Alternatively, additional slots corresponding to the outer tabs 84 may be disposed in the tray 12. The slot 90 may be formed in any suitable way. In a particular example, the slot 90 may be cut along a fold line at a top edge of the tray 12. In this manner, the slot 90 may provide access between two layers of material used to construct the tray 12.

Figure 4:
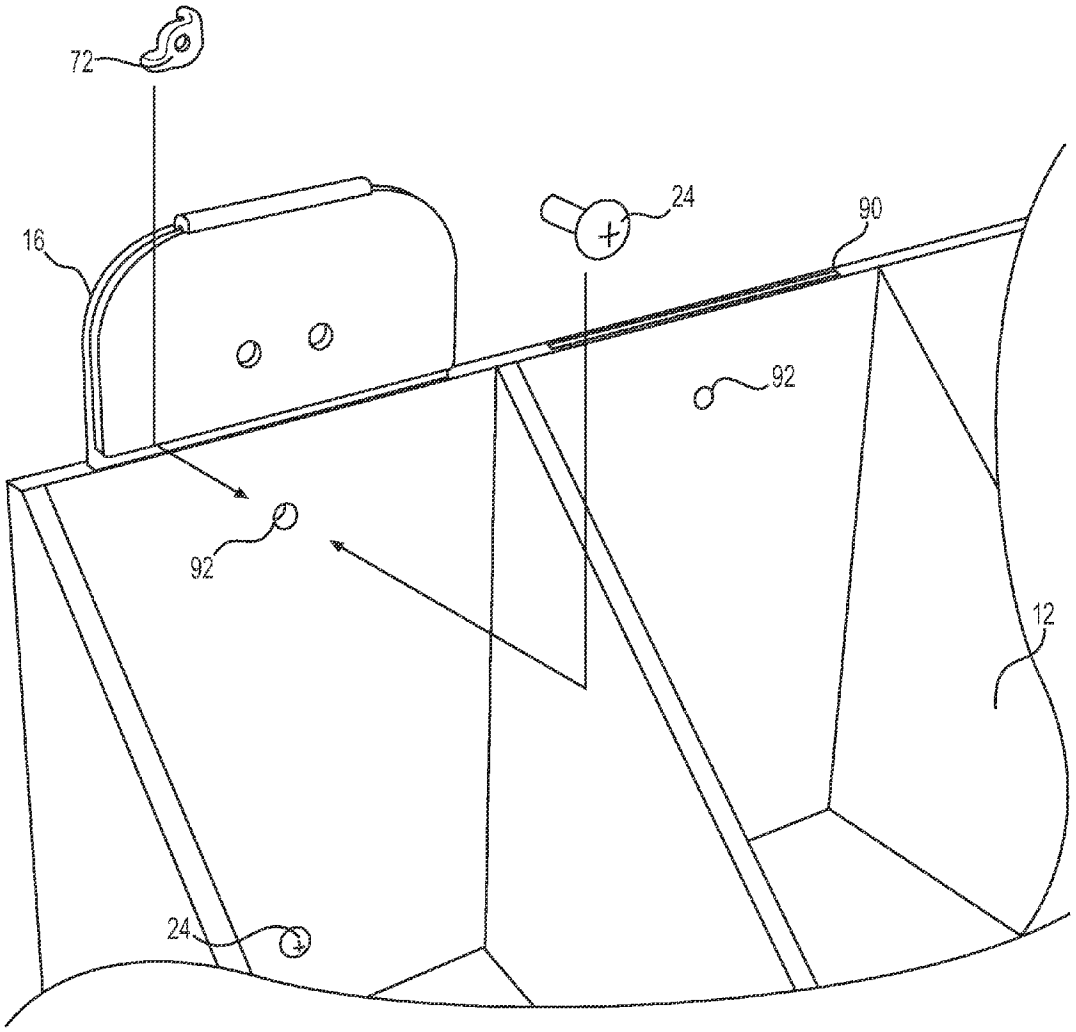
FIG. 4 is a perspective view of an intermediate step in the assembly of the security tray system according to FIG. 1.

FIG. 4 is a perspective view of an intermediate step in the assembly of the security tray system 10 according to FIG. 1. As shown in FIG. 4, the header panel 16 may be secured in the slot 90 with the fastener 24. In a particular example, the fastener 24 is inserted through a hole 92, the fastener hole 70, and secured with the wing nut 72. In this manner, the tab 80 may be prevented from being withdrawn without first removing the fastener 24.

Figure 5:
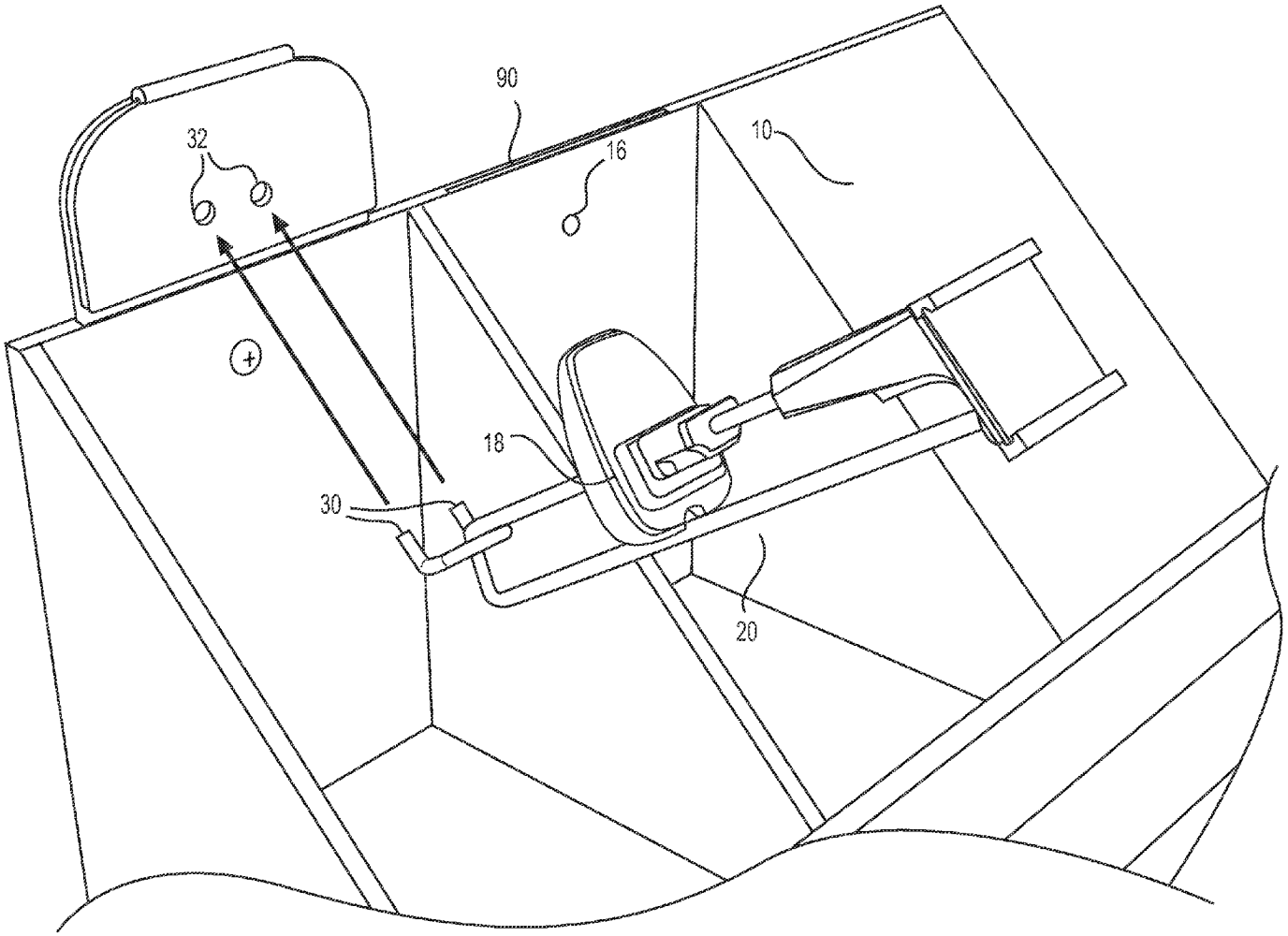
FIG. 5 is a perspective view of another intermediate step in the assembly of the security tray system according to FIG. 1.

FIG. 5 is a perspective view of another intermediate step in the assembly of the security tray system 10 according to FIG. 1. As shown in FIG. 5, the hook 20 is attached to the header panel 16 by angling the hook 20 and inserting the prongs 30 into the holes 32. Once inserted, the hook 20 is rotated downward to attach the hook 20 to the header panel 16. Once the hook 20 is attached, the hook base cover 18 may be slid towards the header panel 16 and locked. Additional hooks 20 may be similarly secured to the tray 12 as desired.

Figure 6:
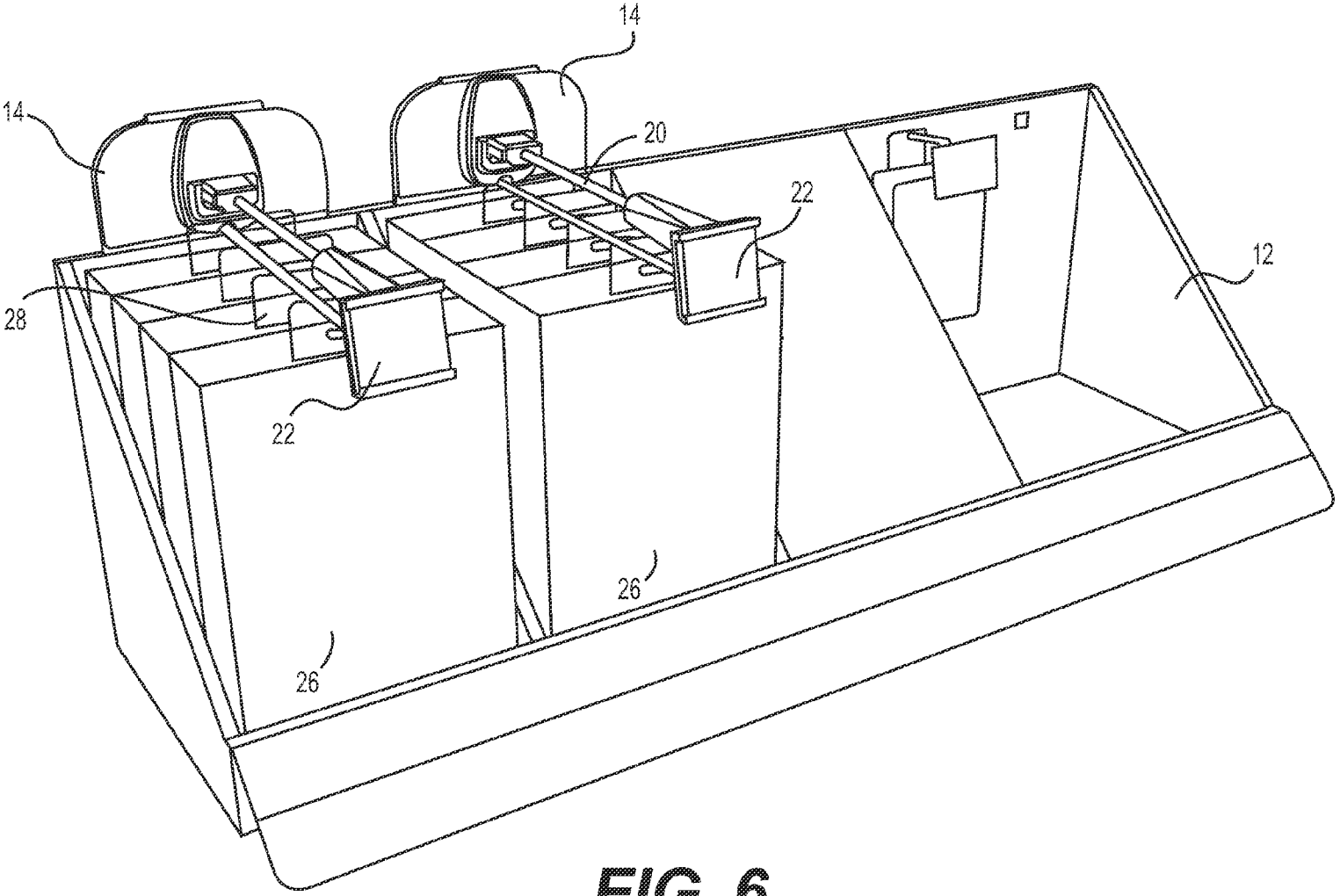
FIG. 6 is a perspective view of yet another intermediate step in the assembly of the security tray system according to FIG. 1.

FIG. 6 is a perspective view of yet another intermediate step in the assembly of the security tray system 10 according to FIG. 1. As shown in FIG. 6, the security tray system 10 may be configured to securely display a plurality of the products 26. As described herein, the products 26 may be displayed in a prominent location while remaining resistant to theft.

Additionally, any one or more of the features described above may be utilized to retrofit an existing retail display unit in order to provide enhanced security for a plurality of products. In this regard, the invention also is contemplated as useful in a retrofit manner and includes a method of retrofitting a prior art retail display unit. For example, an existing display unit may be modified to have a slot 90 and/or modified to receive a fastener 24. The existing display unit may further be modified to receive the header 16 and other associated structure consistent with the description herein. Thus, an existing display unit without any security features can be retrofitted to have security features.

For certain small, high-value, goods, losses from theft can have a negative impact on overall profitability. By reducing theft, profitability may be retained. Examples of goods particularly suitable for display in the security tray system 10 include mobile phones, video games, software, cameras, other electronic items, jewelry, and the like.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A security system comprising:

a display tray to display an item, the display tray including a slot;

a header panel having a tab portion and a head portion, the tab portion being configured to mate with the slot, the head portion having one or more prong receiving holes;

a plurality of outer tabs disposed at opposite ends of the head portion to increase alignment of the head portion with the slot;

a hook having one or more prongs, an upper rod and a lower rod, the lower rod being configured to receive a hang tab of the item, the one or more prongs being configured to mate with the one or more prong receiving holes;

a hook base cover to secure the hook to the head portion; and a hook end cover configured to lock to an end of the hook, wherein the item received on the hook is secured by locking the hook end cover to the hook.

2. The security system according to claim 1, further comprising:

a fastener configured to pass through a first hole in the display tray and a second hole in the tab portion to secure the header panel to the display tray.

3. The security system according to claim 2, further comprising:

a wing nut to mate with the fastener to secure the fastener in the first hole and second hole.

4. The security system according to claim 1, further comprising:

a base lock configured to secure the hook base cover to the hook.

5. The security system according to claim 1, further comprising:

a hook end lock configured to secure the hook end cover to the hook.

6. The security system according to claim 5, further comprising:

a key to selectively lock and unlock the hook end lock to and from the hook.

7. The security system according to claim 5, wherein the hook end lock is a one way lock that is configured to permanently lock the hook end cover to the hook.

8. The security system according to claim 1, wherein the security system is configured to rest on a cabinet or shelf.

9. The security system according to claim 1, wherein the security system is configured to be secured to a base.

10. A security hook assembly comprising:

a header panel having a tab portion and a head portion, the tab portion being configured to mate with a slot in a display tray, the head portion having one or more prong receiving holes;

a plurality of outer tabs disposed at opposite ends of the head portion to increase alignment of the head portion with the slot;

a hook having one or more prongs, an upper rod and a lower rod, the lower rod being configured to receive a hang tab of an item, the one or more prongs being configured to mate with the one or more prong receiving holes;

a hook base cover to secure the hook to the head portion; and a hook end cover configured to lock to an end of the hook, wherein the item received on the hook is secured by locking the hook end cover to the hook.

11. The security hook assembly according to claim 10, further comprising:

a fastener configured to pass through a first hole in the display tray and a second hole in the tab portion to secure the header panel to the display tray.

12. The security hook assembly according to claim 11, further comprising:

a wing nut to mate with the fastener to secure the fastener in the first hole and second hole.

13. The security hook assembly according to claim 10, further comprising:

a base lock configured to secure the hook base cover to the hook.

14. The security hook assembly according to claim 10, further comprising:

a hook end lock configured to secure the hook end cover to the hook.

15. The security hook assembly according to claim 14, further comprising:

a key to selectively lock and unlock the hook end lock to and from the hook.

16. The security hook assembly according to claim 14, wherein the hook end lock is a one way lock that is configured to permanently lock the hook end cover to the hook.

* * * * *